US010603242B2

(12) United States Patent
Vitiello et al.

(10) Patent No.: US 10,603,242 B2
(45) Date of Patent: Mar. 31, 2020

(54) ACTUATION SYSTEM FOR HIP ORTHOSIS

(71) Applicant: SCUOLA SUPERIORE DI STUDI UNIVERSITARI E DI PERFEZIONAMENTO SANT'ANNA, Pisa (IT)

(72) Inventors: Nicola Vitiello, Pontedera (IT); Francesco Giovacchini, Pisa (IT); Marco Cempini, Terricciola (IT); Matteo Fantozzi, Viareggio (IT); Matteo Moise, Ponte Buggianese (IT); Marco Muscolo, Santa Croce sull'Arno (IT); Mario Cortese, Pisa (IT)

(73) Assignee: Scuola Superiore Di Studi Universitari E Di Perfezionamento Sant'Anna, Pisa (IT)

( * ) Notice: Subject to any disclaimer, the term of this patent is extended or adjusted under 35 U.S.C. 154(b) by 243 days.

(21) Appl. No.: 15/542,693

(22) PCT Filed: Feb. 8, 2016

(86) PCT No.: PCT/IB2016/050639
§ 371 (c)(1),
(2) Date: Jul. 11, 2017

(87) PCT Pub. No.: WO2016/128877
PCT Pub. Date: Aug. 18, 2016

(65) Prior Publication Data

US 2017/0367919 A1 Dec. 28, 2017

(30) Foreign Application Priority Data

Feb. 9, 2015 (IT) ..... FI2015A0025

(51) Int. Cl.
*A61H 3/00* (2006.01)
*A61H 1/02* (2006.01)

(52) U.S. Cl.
CPC ..... *A61H 3/00* (2013.01); *A61H 1/0244* (2013.01); *A61H 2201/0192* (2013.01);
(Continued)

(58) Field of Classification Search
CPC ..... A61H 3/00
See application file for complete search history.

(56) References Cited

U.S. PATENT DOCUMENTS

2004/0158175 A1* 8/2004 Ikeuchi ..... A61H 3/008 601/5
2006/0064047 A1* 3/2006 Shimada ..... A61F 5/0102 602/23

(Continued)

FOREIGN PATENT DOCUMENTS

CN 101234043 A 8/2008
CN 104027224 A 9/2014

(Continued)

OTHER PUBLICATIONS

"Shock Absorber Specifications 7610 Series & 76 Series Shock Absorber Springs," https://web.archive.org/web/20050623193629/http://ikonsuspension.com/content/7610-76.html, Retrieved on Sep. 26, 2018, 3 Pages.

(Continued)

*Primary Examiner* — Jacqueline Woznicki
(74) *Attorney, Agent, or Firm* — Workman Nydegger

(57) ABSTRACT

A hip orthosis having:
- an elastic rotary actuator positioned at the rear part of orthosis;
- an extensible transmission system, positioned along the side of the user and suitable for transmitting the action of the actuator to the joint of the hip;
- a link which transmits the mechanical action to user's thigh; and (Continued)

a chain of degrees of freedom through which the three elements are connected to a frame which interfaces the entire orthosis with the user's body is disclosed. The degrees of freedom can be passive, actuated or connected to elastic elements.

8 Claims, 6 Drawing Sheets

(52) U.S. Cl.
CPC ..... *A61H 2201/1215* (2013.01); *A61H 2201/164* (2013.01); *A61H 2201/165* (2013.01); *A61H 2201/1628* (2013.01); *A61H 2201/1676* (2013.01)

(56) References Cited

U.S. PATENT DOCUMENTS

2006/0260620 A1* 11/2006 Kazerooni ..... A61B 5/1038 128/845
2007/0106190 A1* 5/2007 Katoh ..... A61F 5/0102 602/26
2010/0113988 A1* 5/2010 Matsuoka ..... A61H 3/008 601/34
2011/0066088 A1* 3/2011 Little ..... B25J 9/0006 601/35
2011/0166489 A1 7/2011 Angold et al.
2011/0306907 A1* 12/2011 Ashihara ..... A61H 3/008 601/35
2012/0259259 A1* 10/2012 Chugunov ..... A61F 5/0102 602/16
2013/0226048 A1* 8/2013 Unluhisarcikli ..... A61H 3/00 601/34
2014/0100493 A1 4/2014 Craig et al.
2014/0257160 A1* 9/2014 Garrec ..... A61F 5/0102 602/23
2014/0276264 A1 9/2014 Caires et al.
2015/0190248 A1* 7/2015 Vitiello ..... A61F 2/60 623/24
2015/0223959 A1* 8/2015 Cempini ..... A61H 1/0285 602/22
2015/0272809 A1* 10/2015 Accoto ..... A61H 1/0237 623/31
2015/0272811 A1* 10/2015 Choi ..... B25J 17/00 623/27
2015/0335514 A1* 11/2015 Choi ..... A61H 3/00 623/27
2015/0335515 A1* 11/2015 Lee ..... A61H 3/008 601/5
2015/0336265 A1* 11/2015 Choi ..... B25J 9/0006 414/4
2016/0015532 A1* 1/2016 Lee ..... A61F 2/70 623/24
2016/0015589 A1* 1/2016 Lee ..... A61H 1/0262 602/16
2016/0016307 A1* 1/2016 Choi ..... A61H 3/00 74/423
2016/0030271 A1* 2/2016 Roh ..... A61H 1/0277 602/16
2016/0038313 A1* 2/2016 Kim ..... B25J 9/102 623/24
2016/0038328 A1* 2/2016 Choi ..... A61F 5/0123 602/16
2016/0038368 A1* 2/2016 Lee ..... A61H 3/00 623/24
2016/0045387 A1* 2/2016 Lee ..... A61H 3/008 602/12
2016/0081870 A1* 3/2016 Lee ..... A61F 2/605 623/27
2016/0106615 A1* 4/2016 Lee ..... A61H 3/00 414/4
2016/0151227 A1* 6/2016 Choi ..... A61H 3/00 623/27
2016/0158029 A1* 6/2016 Kuiken ..... A61F 2/60 623/24
2016/0193102 A1* 7/2016 Roh ..... A61H 3/00 623/27
2016/0215864 A1* 7/2016 Kim ..... A61F 2/60
2016/0270997 A1* 9/2016 Little ..... A61H 3/00
2017/0020692 A1* 1/2017 Lee ..... A61F 2/604
2017/0056276 A1* 3/2017 Lee ..... G16H 10/60
2017/0065441 A1* 3/2017 Lee ..... A61F 2/72
2017/0086990 A1* 3/2017 Choi ..... A61F 2/605
2017/0119613 A1* 5/2017 Roh ..... B25J 9/1045
2017/0128311 A1* 5/2017 Lee ..... F16H 19/06
2017/0290684 A1* 10/2017 Lenzi ..... A61F 2/6607
2017/0367919 A1* 12/2017 Vitiello ..... A61H 1/0244
2018/0071163 A1* 3/2018 Cempini ..... A61H 1/0277
2018/0147108 A1* 5/2018 Lee ..... A61H 1/0244

FOREIGN PATENT DOCUMENTS

EP 2762123 A1 8/2014
FR 2981266 A1 4/2013
KR 20120076101 A 7/2012
WO 2014057410 A1 4/2014
WO 2014125387 A2 8/2014
WO 2016065350 A1 4/2016

OTHER PUBLICATIONS

Hain, "The Spring Balancing of Loads," Institute of Landtechnik Basic Research the Research Institute for Agriculture Braunschweig-Volkenrode, No. 3, Jan. 1, 1952, pp. 38-50.
International Search Report from PCT Application No. PCT/IB2018/054513, dated Oct. 12, 2018.
International Search Report and Written Opinion for International Application No. PCT/IB2016/050639 (dated Oct. 21, 2016)(10 Pages).

* cited by examiner

ACTUATION SYSTEM FOR HIP ORTHOSIS

CROSS-REFERENCE TO RELATED APPLICATIONS

This application is a 371 of PCT/IB2016/050639, filed Feb. 8, 2016, which claims the benefit of Italian Patent Application No. FI2015A000025, filed Feb. 9, 2015.

TECHNICAL FIELD OF THE INVENTION

The present invention mainly relates to an actuation system for an active orthosis—or an exoskeleton—bearing a hip joint.

BACKGROUND

As known for many years, the average age of the world population has considerably risen. Motor disorders associated with aging suggest a future scenario wherein people with care needs in moving—especially walking and in activities connected with the fulfillment of their daily activities, even at home—will be more and more.

The robotic orthoses of the type also known as exoskeletons represent a promising solution to assist people—elderly and not—living with motor deficits. These orthosis have usually anthropomorphic form and are "worn" from the subject. For active assistance "purposes", the orthosis can include a group of actuation which generates mechanical power and transfers it to the affected joint segment, frequently the user hip.

Several authors (A. B. Zoss, H. Kazerooni: "*Biomechanical Design of the Berkeley Lower Extremity, Exoskeleton—BLEEX*"; *IEEE/ASME Transactions on Mechatronics*, vol. 11, no. 2, April 2006) describe an exoskeleton equipped with a hydraulic actuator for generating the flexion-extension torque of the hip. This actuator is arranged laterally to the user's body, in correspondence of the femur. However, this positioning entails an increase in weight on the articular segment concerned, which has as a consequence an increase of the involved inertia. Moreover, the center of gravity of the whole structure is lower than the physiological one.

Also US 2011/166489 refers to an active hip orthosis, comprising a group of hydraulic actuation positioned posteriorly to the user's body.

The orthoses/exoskeletons of known type mentioned above have some drawbacks or unresolved needs.

First, the orthosis structure must be compatible with the degrees of freedom, the angular extensions and, in general, the kinematics of the body joints, including those not assisted.

Moreover, the orthosis must be able to adapt to the anthropometry of the subject and realize, on the whole, a human-robot comfortable and cinematically effective interface.

In addition, the above should be obtained with a limited mechanical complexity of the orthosis, also for the benefit of its reliability.

Finally, more critical aspects that could be optimized, also in relation to the other requirements set out above, are:

- the position of the actuator elements with respect to the subject's body,
- the mechanism of transmission of assistive action,
- the aforementioned number and positioning of passive degrees of freedom,
- the number and positioning of orthosis adaptation means to different users anthropometries (this feature is of particular importance when the same orthotic system is to be used by different subjects).

SUMMARY

The technical problem posed and solved by the present invention is therefore to provide an actuation system of an hip orthosis which allows to obviate the drawbacks mentioned above with reference to prior art.

This problem is solved by an actuation system. In particular, the invention provides a monolateral actuation system for an active hip orthosis dedicated to the assistance of the flexion-extension movement of the hip.

The invention also provides an orthosis or an exoskeleton, namely an orthosis which includes said actuation system, in particular a so-called "Active Orthosis Pelvis" (APO).

The active orthosis of the invention can provide assistive pairs of flexion-extension at one or both hips of the user.

In the present context, for orthosis it is precisely intended an exoskeletal structure which extends at the hip articulation, in particular at the basin and at least at part of the user's lower limbs.

Preferred features of the present invention are object of the dependent claims.

The actuation system of the invention has limited lateral dimensions, allowing the subject to freely make the movement of the so-called "swing" of the arms. Such a limited lateral encumbrance is a consequence of the positioning of an actuator, such as rotary, in the back of the system itself (i.e. at the back of the user).

Such actuation system enables the user to freely perform abduction-adduction movements and, preferably, of intra-extra rotation of the hip, realizing a "floating" configuration for the actuator itself.

Furthermore, preferably, the system is configured to adapt to different anthropometries of the subject. In particular, the system includes a transmission device extending substantially parallel to the sagittal plane of the user and having an adjustable longitudinal dimension, to allow to choose the distance between the actuator and a link which transmits the assistive couple to the articular segment of thigh.

Very advantageously, the actuation system is configured in such a way that its own axis of flexion-extension of the hip and its own axis of abduction/adduction of the hip are incident in a point corresponding, in use, to the center of the femoral head of the user. This is achieved, in particular, through the above mentioned adjustment of the longitudinal extension of the transmission device and by means of a corresponding adjustability of the width of the actuation system on the frontal plane of the user.

The invention is effective in assisting many physical activities, particularly walking on ground level and uphill/downhill, the ascent/descent of steps, the transition from sitting/standing ("sit-to-stand") or vice versa, and in general, motor activities for rehabilitation of the lower limbs.

The actuation system of the invention makes the orthosis be perfectly compatible with the degrees of freedom, the angular extensions and, in general, the kinematics of the joints of the user, including the passive ones.

In addition, the system is compatible to a realization of low cost and low mechanical complexity.

Other advantages, features and the modes of employ of the present invention will become apparent from the following detailed description of some embodiments thereof, given by way of example and not of limitation.

BRIEF DESCRIPTION OF DRAWINGS

Reference will be made to the figures of the accompanying drawings, wherein.

The dimensions, the angles and curvatures represented in the figures introduced above are to be understood as exemplary and not necessarily shown in proportion.

DETAILED DESCRIPTION OF PREFERRED EMBODIMENTS

Figure 1:
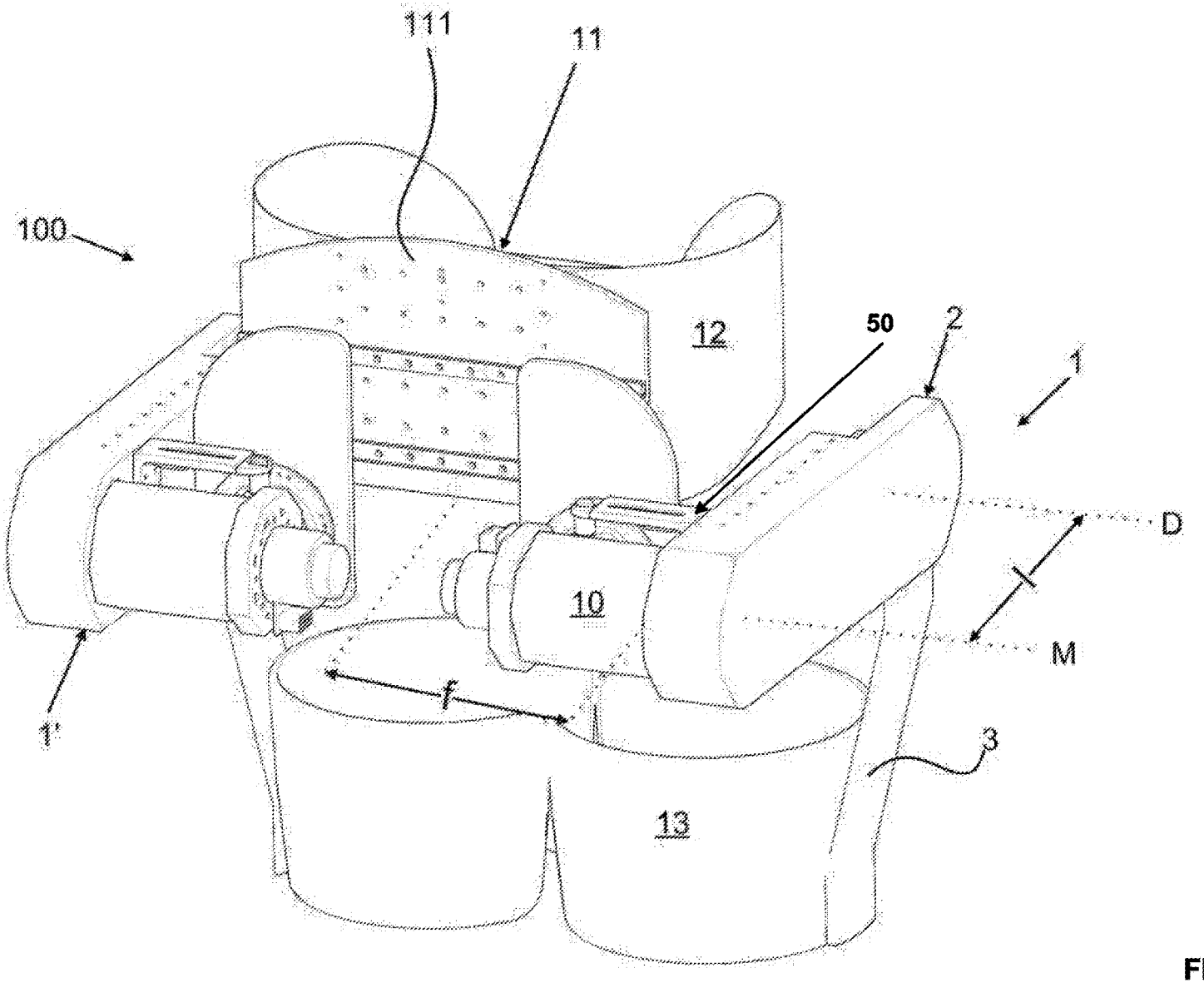
FIG. 1 shows a perspective rear view of a preferred embodiment of an actuation system according to the present invention and an orthosis which includes it.
Figure 2:
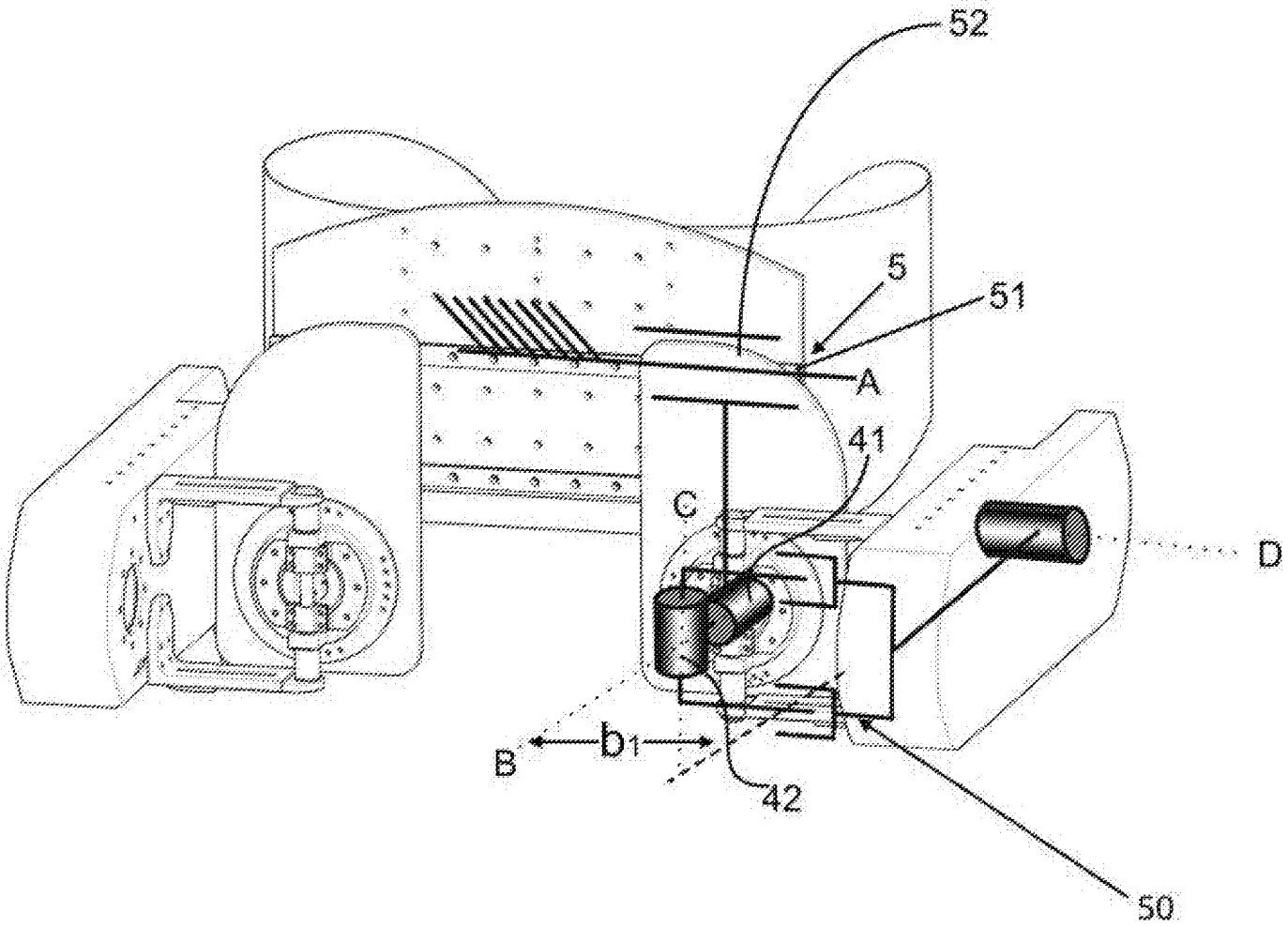
FIG. 2 shows another perspective rear view of the system of FIG. 1, wherein some components have been omitted to illustrate with greater clarity a kinematic chain of the system.

With reference initially to FIGS. 1 and 2, a hip orthosis according to a preferred embodiment of the invention is generally denoted by 100. The orthosis 100 is a so-called "Active Orthosis Pelvis" (APO).

The orthosis 100 includes two monolateral actuation systems, one for each hip articulation, denoted respectively by 1 and 1' and each realized according to a preferred embodiment of the invention. Since the two systems 1 and 1' are identical, unless the necessary adaptations to make them suitable to left and right articulation, respectively, from now on we will refer only to the right device denoted by 1.

The actuation system 1 comprises firstly a fixed frame 11, for the connection, permanently or removably, to the structure of the orthosis 100. In the present case, the frame 11 includes a connection plate or flange 111.

The frame 11 interfaces and stabilizes the orthosis 100 on the body of the user, and can be secured to the latter by means of an appropriate orthotic shell of pelvis or torso, shown by way of example and denoted by 12.

A first linear joint 5 which will be described in brief, a rotary joint 41 of abduction-adduction, a rotary joint 42 which we will say of intra/extra-rotation since, in combination with the first linear joint 5, allows the execution of said movement at the hip, motor means 10, in particular a rotary actuator, and a transmission device 2 are connected, mechanically in series, to the fixed frame 11. Each of these components will now be described in greater detail.

Rotary joints 41 and 42 are made, in a known way, such as kinematic couples with a rotational degree of freedom around, respectively, an adduction-abduction B axis and a C axis parallel to the axis of physiological intra-extra-rotation, with the C axis orthogonal and incident to the axis B.

As said, the joints 5 (translational), 41 and 42 are arranged in serial kinematical chain between the fixed frame 11 and the motor means 10. Said joints 5, 41 and 42 then perform a chain of degrees of freedom/adjusting chain by means of which the motor means 10 and the transmission device 2 are connected to the frame 11. These degrees of freedom can be passive, as in the example here considered, or actuated or connected to elastic elements.

The rotary actuator 10 may be of the type called SEA ("Series Elastic Actuator"), known per se in the art. According to the invention, the actuator 10 is disposed at a rear portion of the orthosis 100 corresponding to the user's back. The actuator 10 is configured to provide an assistive couple at its own motor axis M. The latter is an axis substantially parallel to the axis around which takes place the movement of flexion-extension of the hip of the subject, in other words an axis substantially perpendicular to the sagittal plane.

The transmission device 2 is mechanically connected to the motor axis M and configured to transfer said assistive couple on an output axis D which reproduces the physiological axis of flexion-extension of the hip. M and D axes are parallel or substantially parallel.

In a variant embodiment, the motor axis M can also be arranged non-parallel to the output axis D (for example vertical or substantially vertical). In this case, the transmission device will be correspondingly modified.

The transmission device 2 is configured to be disposed, in use, at a side of the user, substantially parallel to the sagittal plane of the user. In other words, the transmission device 2 extends mainly in a direction orthogonal to the axes M and D.

The transmission device 2 presents a longitudinal extension, i.e. a transverse extension in the sagittal plane, adjustable. In other words, the transmission device 2 is configured to allow an adjustment of the distance, on the sagittal plane of the user, between the motor axis M and the output axis D. This distance is denoted by way of example with/in FIG. 1. Therefore, the transmission device 2 is able to adapt to the distance between the back of the subject and the axis of rotation of the hip.

In the present example, a rotatably connecting rod 3, or link, is connected, in particular keyed, to the output axis D. The link 3 is configured to engage a user's thigh, possibly by means of an orthotic shell 13 or an analogous element able to distribute in a comfortable way the pressure resulting from the action of the actuator 10, on a sufficiently large surface of the articular segment.

The application of the assistive action by the actuator 10 is realized then in the pushing that the link 3 generates at level of the corresponding articular segment. The device 2 therefore realizes an extensible transmission system which transmits the action of the rotary actuator 10 to the joint of the hip and makes possible the alignment in the sagittal plane of the rotation axis D of the link 3 with the axis of the hip user.

On the basis of what has been described, it will be understood that the overall configuration of the system 1 is such that the motor means 10 and the transmission device 2 result floating with respect to frame 11, and this by virtue mainly of the interposition of rotary joints 41 and 42. Therefore, the rotary actuator 10 may be called as "Rear Floating Hip Actuator".

Therefore, it can be said that the actuation system is integral to the thigh of the user and, thanks to the kinematic chain by means of which is fixed to the frame of the orthosis, allows the execution of all the movements of the hip articulation.

Figure 3:
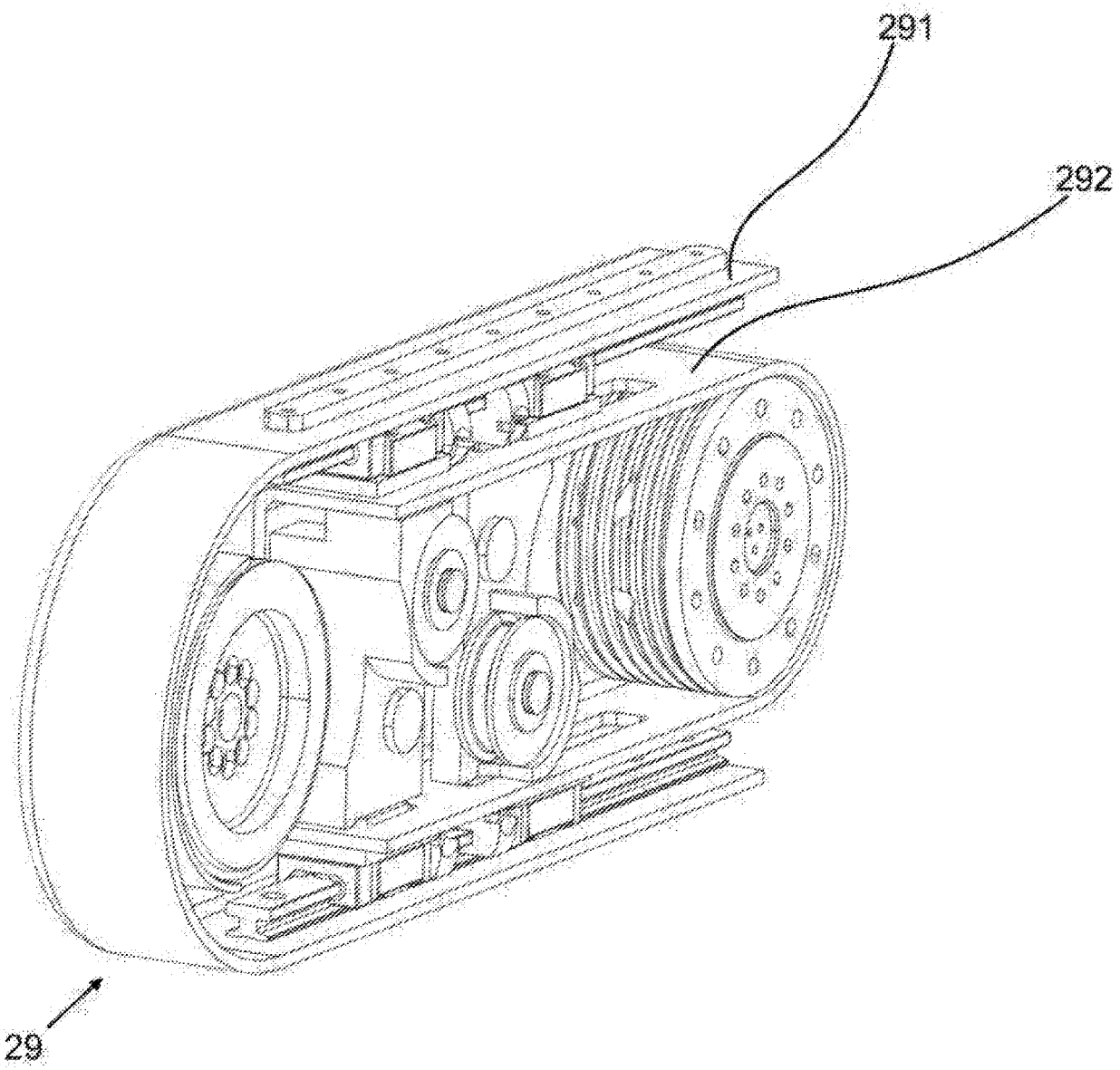
FIG. 3 shows an exemplary perspective side view of an advantageous embodiment of a transmission device of the system of FIG. 1.
Figure 4A:
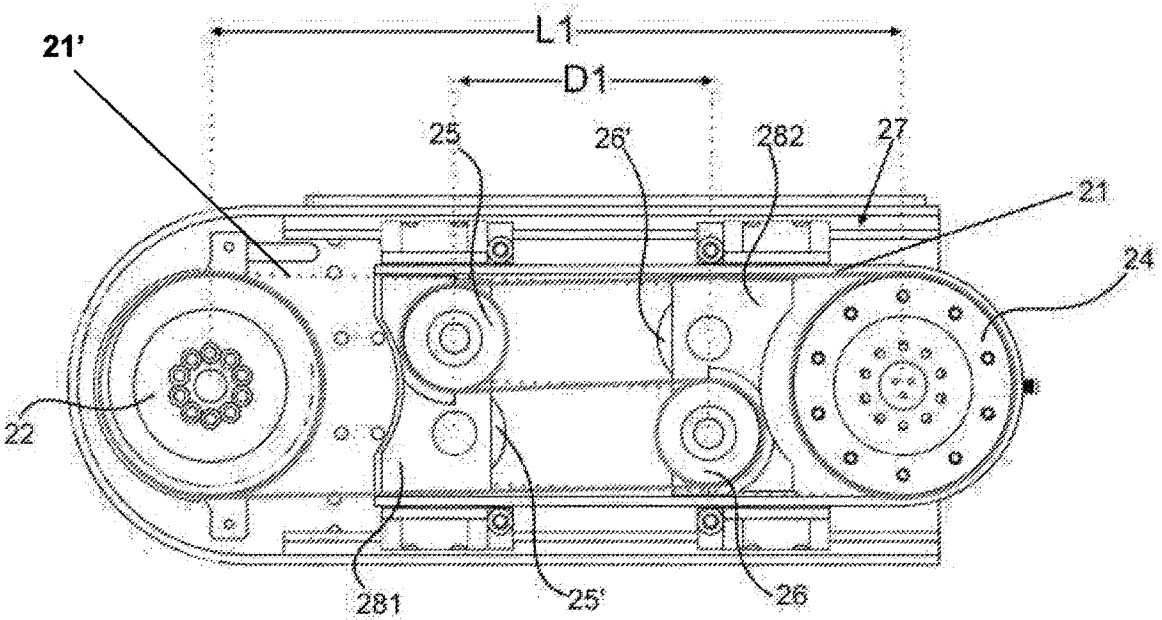
FIGS. 4A and 4B each shows a side view of the device of FIG. 3, respectively in a configuration of minimum and maximum longitudinal extension.
Figure 4B:
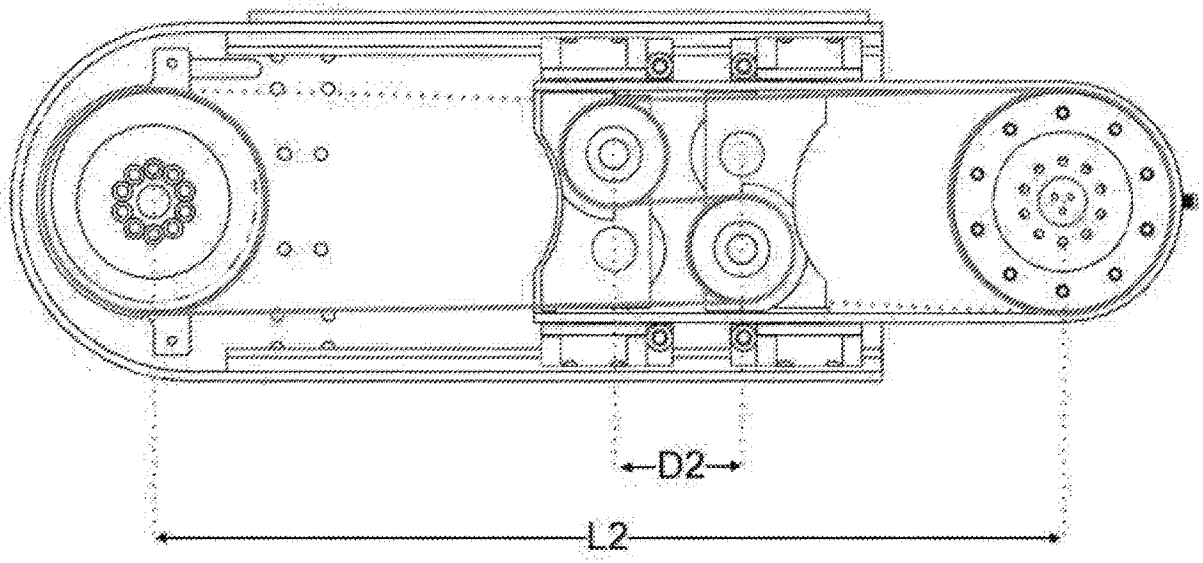
Figure 5A:
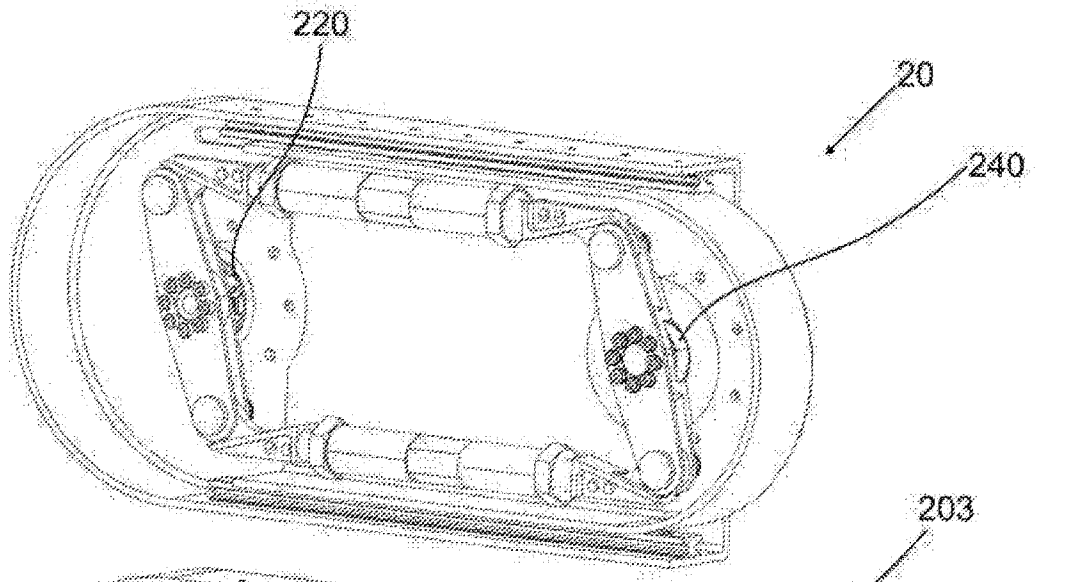
FIGS. 5A and 5B each shows an exemplary perspective side view of another advantageous embodiment of a transmission device of the system of FIG. 1, respectively in a configuration of minimum and maximum longitudinal extension.
Figure 5B:
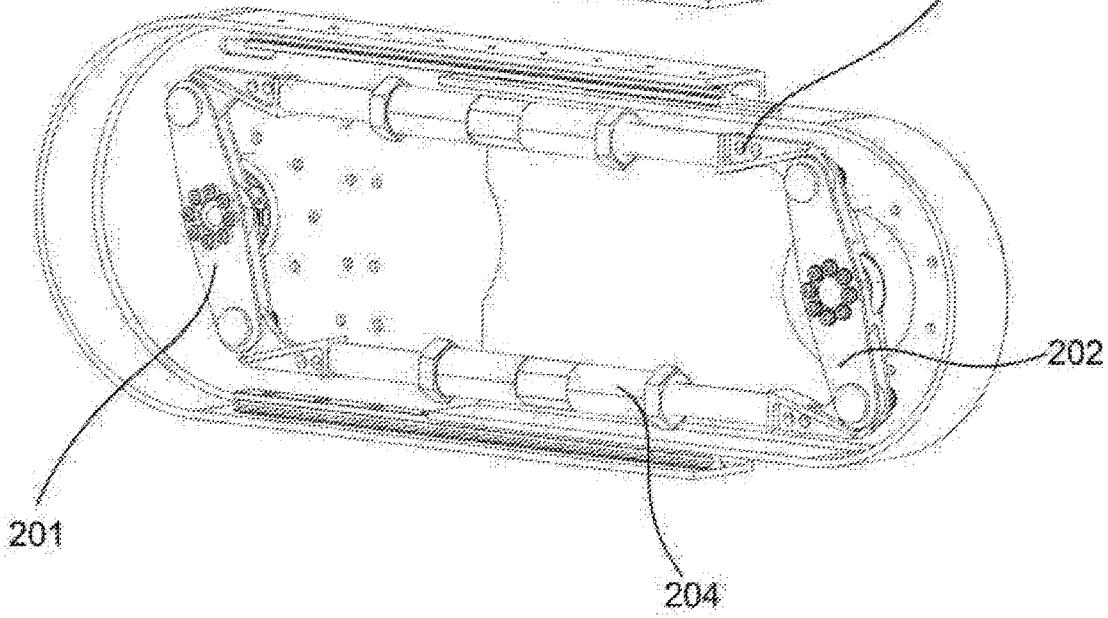

FIGS. 1 and 2 and, in greater detail, FIGS. 3, 4A and 4B show a first preferred embodiment of the transmission device 2. In this embodiment, it is a device based on one or more flexible elongated elements, for example cables, chains, belts, which engage a plurality of pulleys or equivalent components. In the present example there is a pair of annular cables 21 and 21'. Each cable is wound on two common main pulleys (one relative to the motor axis M and denoted by 22 and one relative to the output axis D and denoted by 24) and on two idle drive pulleys of return, respectively 25, 25' and 26, 26'. All the considered six pulleys are rotatable about axes parallel to each other and substantially perpendicular, in use, to the sagittal plane of the user.

In the example shown, the device includes then:

- a main driving pulley 22, connected to the motor shaft M to receive the motion;
- a main driven pulley 24, with axis corresponding to the output axis D; and
- four intermediate pulleys of return, smaller, 25, 25', 26 and 26'.

The pulley 24 and the two pairs of pulleys of return 25-25 'and 26-26' are slidable in a direction perpendicular to their axes by means of a sliding mechanism 27 associated with a casing 29. The latter can be constituted by two box-shaped elements 291 and 292, partially received one in the other and made for example of carbon fiber. The two box-shaped elements 291 and 292 can slide relative to one another, thereby modifying the distance between the motor axis M and the driven axis D respectively integral to them. In the particular case, the external box-shaped element 291 has two rails on which two carriages integral to the inner element 292 run. The main driven pulley 24 and the pair of return pulleys 25-25' are integral to the box-shaped element 292. The main driving pulley 22 is fixedly connected to the element 291.

The two inner pairs of pulleys 25-25' and 26-26' are placed on two distinct elements, or flanges, 281 and 282. The element 281 is integral to the box-shaped element 292, while the element 282 is free to slide by means of carriages on the rails above described, also independently by the sliding of the second box-shaped element 292.

The mutual positioning of the two elements 281 and 282 and of the two box-shaped elements 291 and 292 allows to obtain a correct tension of the cables 21 which connect the pulleys, for any distance between the two main pulleys 22 and 24.

As exemplified in FIG. 4A, the device is capable of assuming a first configuration of minimum extension, corresponding to a maximum distance D1 between the axes of the return pulleys 25 and 26 (and correspondingly between the axes 25' and 26') and at a minimum distance L1 between the axes of the main pulleys 22 and 24.

As exemplified in FIG. 4B, the device is able to assume a second configuration of maximum extension, corresponding to a minimum distance D2 between the axes of the return pulleys 25 and 26 (and correspondingly between the axes 25' and 26') and at a maximum distance L2 between the axes of the main pulleys 22 and 24.

The device 2 naturally comprises locking means for fixing in position the pulleys at and between the two extreme positions above described, depending on the anthropometry of the user and the specific motor and/or rehabilitation requirements. In the example here considered, elements which can be fixed by screws on the rail block the carriages in the desired position.

FIGS. 5A to 6B refer to a second embodiment of the transmission device, in this case overall denoted by 20.

The device 20 also comprises a main rotatable motor member, or motor roller, 220 connected to the motor shaft M and a main rotatable driven element, or roller, 240, associated with the output axis D.

On each of these rollers 220 and 240 a respective arm 201, 202, or crank, is mounted, associated with the respective roller at its own central portion.

The longitudinal ends of each arm are connected to a respective end of a first and a second rigid rod-like element, or rod, 203 and 204, realizing a configuration substantially of an articulated parallelogram.

Figure 6A:
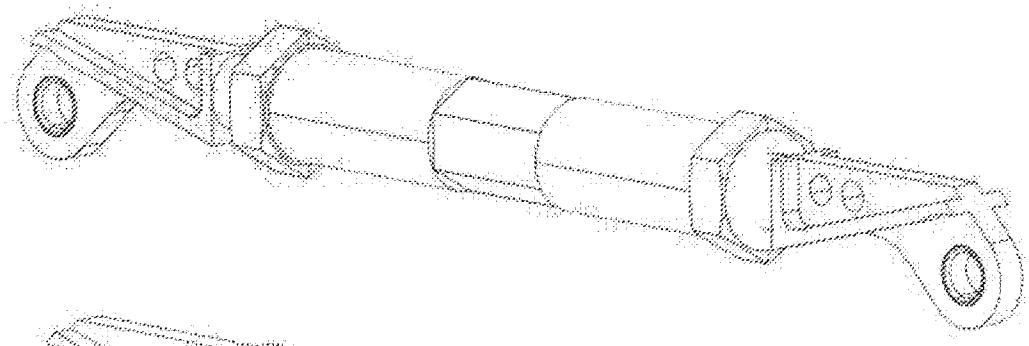
FIGS. 6A and 6B each shows an exemplary side perspective view of a component of the device of FIGS. 5A, 5B, respectively in a configuration of minimum and maximum extension.
Figure 6B:
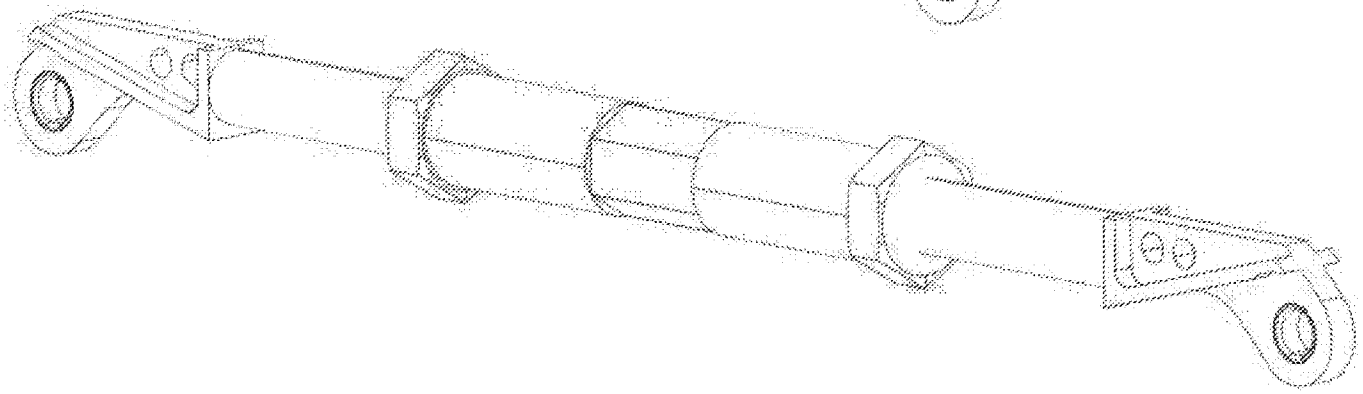

As best shown in FIGS. 6A and 6B, each rod-like element 203, 204 has adjustable longitudinal extension, associated with a telescopic or equivalent configuration lockable in a plurality of configurations.

A specific solution for the implementation of each element 203, 204 consists of a three parts building: a central part, made of a hollow tree internally threaded, having for a half a left hand spiral threading and for a half a right hand spiral threading; and two end portions which connect the rotational joint of the parallelogram crank with the central part of each connecting rod 203, 204. The two end elements of each connecting rod 203, 204 may be identical, except for the threads for coupling with the central part, one of which made according to a right hand spiral threading and the other one according to a left hand spiral threading.

In both the embodiments described, the transmission device 2, 20 is suitable to be realized with reduced thickness.

With reference again to FIGS. 1 and 2, as already mentioned in the present example, the system 1 also provides a device of adjustment, or variation, of the width in the user's front plane, overall denoted by 5 and based on a linear joint. The linear joint is made in a known way as a kinematic pair with one translational degree of freedom along a horizontal direction parallel to the user's frontal plane.

The linear joint 5 can also realize, in use, a linear degree of freedom of the actuation system 1 and of the orthosis 100 which includes it.

Said device comprises, in the present example, a slide mechanism formed by one or more guides or rails 51 associated with the fixed frame 11 and one or more sliding elements or plates 52 connected to the joint 41. The linear joint extends along a front axis A substantially parallel to the axes M and D.

The device 5 allows to adjust, before the use or continuously, the width of the actuation system 1 in the frontal plane, represented by an exemplified dimension fin FIG. 1.

There is also a further mechanism 50 of transverse adjustment—the latter can be locked in a predetermined position, in particular by means of screw systems, according to the anthropometry of the subject—suitable to allow a width adjustment of the actuation system and interposed between the joint 42 and the transmission device; specifically, this mechanism allows to adjust the distance, always in the frontal plane, of the adduction-abduction joint 41 from the side of the person (or similarly from the sagittal plane), associated with the dimension b1 in FIG. 2. Mechanism 50 is therefore an additional linear joint configured so as to allow an adjustment of the horizontal distance between rotary joint 41 and transmission device 2 upon the fontal plane of the user. The adjustment of distance b1 is independent from the adjustment of aforementioned distance f. In this way, an alignment with the physiological rotation axis is obtained.

The presence of the adjustment device 5, and preferably of the device 50, and the adjustability of the transverse-sagittal extension of the transmission device 2 allows to make the B axis of abduction/adduction and the M axis of flexion/extension being incident at the center, or centroid, of the femoral head of the subject wearing the orthosis.

The system 1 may also include a vertical position (height) adjustment device of the motor means 10 and of the other components of the system. Such a device can also be lockable in a predetermined position according to the anthropometry of the subject, or can provide, in use, a further linear degree of freedom to the actuation system.

It will therefore be understood that the actuation system 1 realizes a kinematic chain between the frame 11 and the link 3. In particular, the rotary joint 41 represents the abduction-adduction joint of the human hip, while the combination of the two degrees of freedom along/around A and C axes, together with a possible slight degree of lability inherent to the thigh-link coupling, allows free running of the movement of intra-extra rotation at level of the hip. The entire kinematic chain naturally ends with the flexion-extension joint of the hip around the axis D realized by link 3.

At this point it will be better understood that the orthosis 100 provides a bilateral exoskeleton system which can assist the flexion-extension of the hip. This system is able to provide high assistive couples and has a low total mass.

The implementation of the transmission system so far described provides an its spatial configuration relative to user's body wherein the longitudinal axis of the transmission system is parallel to the transverse plane of the person. In this configuration, the actuation motor axis M and the driven axis D are at the same height with respect to the transverse plane.

The presence of the actuation group in rear position with respect to the body of the person still allows a variant embodiment wherein the actuator is positioned at a different height with respect to the hip axis-joint, i.e. to the driven axis D. The possibility of positioning the actuation group higher than the axis-joint allows, on one hand, to avoid an encumbrance in the lower part of the back resulting in inability to sit, on the other hand to position the center of gravity of the entire structure upper, with positive consequences in terms of energy expenditure during the walk. In this variant embodiment, the transmission device is arranged inclined, i.e. not horizontal.

The present invention has hereto been described with reference to preferred embodiments. It is to be understood that there may be other embodiments afferent to the same inventive core, as defined by the scope of protection of the claims set out below.

The invention claimed is:

1. A monolateral actuation system of a hip articulation, configured to be connected to an orthosis, which monolateral actuation system comprises:

a motor device, capable of providing an assistive torque at a motor axis and configured to be arranged at a rear portion of the orthosis corresponding to a user's back;

a transmission device, connected to said motor axis for transferring said assistive torque onto an output axis corresponding to an axis of flexion-extension of the hip articulation and parallel to said motor axis, which transmission device has an adjustable extension corresponding, in use, to a transverse extension in the sagittal plane of the user, said transmission device being configured to allow adjustment of a transverse distance, in the sagittal plane of the user, between said driving axis and said output axis, wherein said transmission device is configured to be arranged, in use, at a side of the user;

a fixed frame for connection to the orthosis, onto which said motor device and said transmission device are mounted;

a rotary joint, corresponding to a degree of freedom of abduction/adduction of the hip articulation about a respective adduction/abduction axis of the hip articulation, which rotary joint is interposed between fixed said frame and said motor device;

a linear joint, interposed between said fixed frame and said rotary joint, which linear joint is configured to adjust a horizontal width of the monolateral actuation system on the frontal plane of the user.

2. The system according to claim 1, wherein said motor device comprises a rotary actuator.

3. The system according to claim 1, wherein said transmission device is configured to be arranged, in use, parallel to the sagittal plane of the user.

4. The system according to claim 1, wherein said transmission device includes flexible cables and comprises a plurality of pulleys engaged by said flexible cables.

5. The system according to claim 1, wherein said transmission device comprises a plurality of elongated rigid elements rotatably connected to one another.

6. The system according to claim 1, comprising a rotatable link connected to said transmission device at said output axis and configured to engage a user's thigh.

7. The system according to claim 1, wherein said linear joint comprises a fixed element associated with said fixed frame, and the linear joint further comprises a movable element, slidable with respect to said fixed element.

8. The system according to claim 1, comprising an adjusting element arranged to adjust a vertical position of said motor device.

* * * * *